United States Patent [19]

Landry et al.

[11] Patent Number: 4,995,641

[45] Date of Patent: Feb. 26, 1991

[54] NOTE PAD FOR ENTRY INTO PERMANENT RECORDS

[75] Inventors: John C. Landry; Michael R. Bourque, both of Farmington, Conn.

[73] Assignee: Insight Media, Inc., Farmington, Conn.

[21] Appl. No.: 513,838

[22] Filed: Apr. 24, 1990

[51] Int. Cl.[5] ..... B42D 15/00

[52] U.S. Cl. ..... 283/67; 281/2; 281/3.1; 281/15.1

[58] Field of Search ..... 283/67; 281/2, 3.1, 281/15; 428/194

[56] References Cited

U.S. PATENT DOCUMENTS

| | | | |
|---|---|---|---|
| 2,123,903 | 2/1935 | Lane et al. . | |
| 3,290,059 | 12/1966 | Newman | 281/3.1 |
| 3,517,450 | 2/1968 | Greco . | |
| 3,930,700 | 1/1976 | Figueres . | |
| 3,968,350 | 7/1976 | Watson . | |
| 3,987,960 | 10/1976 | Gardiner . | |
| 4,029,341 | 6/1977 | Neill et al. . | |
| 4,105,224 | 8/1978 | Rodebaugh et al. | 428/194 |
| 4,110,502 | 8/1978 | Baer . | |
| 4,128,954 | 12/1978 | White . | |
| 4,159,129 | 6/1979 | Lockhart . | |
| 4,215,879 | 8/1980 | Blum . | |
| 4,312,523 | 1/1982 | Haines . | |
| 4,329,191 | 5/1982 | Barber . | |
| 4,500,021 | 2/1985 | Bildusas . | |
| 4,714,276 | 12/1987 | Greig . | |
| 4,799,712 | 1/1989 | Biava et al. . | |
| 4,822,074 | 4/1989 | Hueffman et al. . | |
| 4,884,826 | 12/1989 | Slagsvol | 281/2 |

OTHER PUBLICATIONS

United States Statutory Invention Registration #H377, Dec. 1987, Greig.

*Primary Examiner*—Hien H. Phan
*Assistant Examiner*—Hwei-Siu Payer

[57] ABSTRACT

A note pad for use with hard copy record keeping systems has a stacked pack of flexible sheets, each having a top surface upon which a user may write, and a lower surface having two stripes of adhesive. One of the adhesive stripes is of a tacky repositionable pressure sensitive adhesive, and the other is of a substantially permanent adhesive. Depending upon the adhesive stripe employed to service the note, it can be secured permanently or temporarily to a record keeping sheet. The note pad also includes a binder holding the stacks in assembly and permitting removal of the individual sheets. In one embodiment, the permanent adhesive stripe is also pressure sensitive and it has a strip of release paper thereover.

12 Claims, 2 Drawing Sheets

NOTE PAD FOR ENTRY INTO PERMANENT RECORDS

BACKGROUND OF THE INVENTION

Physicians, lawyers, accountants and others are frequently required to write significant information during telephone conversations on note pads and scratch paper. Frequently, they find it necessary to record the same information onto a permanent record. This generally entails the necessity of copying the information onto a permanent record sheet, and this involves not only a duplication of time and effort, but also the potential for error in effecting such a transfer. Exemplary of the type of information to be permanently preserved are directions to a patient or to a client, information received from a patient or client upon which the doctor, lawyer or accountant will act, and significant financial and other data.

It will be appreciated that such notes could be affixed to a record sheet by applying adhesive to the back surface, or by adhesive tape, or other suitable means, but this involves use of additional items and it can present the potential for defacing or obscuring portions of the permanent record or the note itself.

In recent years there has been a widespread use of note pads which have a repositionable pressure sensitive adhesive on the reverse side thereof for recording notes and messages. Such note pads have been widely accepted and enjoy extensive usage, but they do not provide for permanent adhesion to a substrate which is necessary for permanent record keeping.

It is an object of the present invention to provide a novel note pad which allows facile recording of information on the top surface, and which may thereafter be permanent)y engaged to a record keeping sheet or like substrate, and which may also be temporarily secured to a support surface until it is desired to effect entry of the permanent record onto the record sheet.

It is also an object to provide such a note pad which may be simply and economically fabricated and which may be quickly used with minimum inconvenience for either temporary adherence to a support or permanent entry onto the record keeping sheet.

Still another object is to provide a record keeping method utilizing such note pads.

SUMMARY OF THE INVENTION

It has now been found that the foregoing and related objects may be readily attained in a note pad for use with hard copy record keeping systems comprising a multiplicity of stacked flexible sheets having a top surface for receiving writings. On the bottom surface of each sheet is a first stripe of a first adhesive extending substantially across one dimension of the sheet, and this adhesive is adapted to adhere firmly to a record keeping sheet. There is also a second stripe of a second adhesive extending substantially across the one dimension, and this adhesive is a tacky repositionable pressure sensitive adhesive which will releasably bond to a record keeping sheet. The note pad also has binder means securing the sheets in stacked assembly and permitting removal of the individual sheets therefrom. Thus, the flexible sheet may be written upon and mounted temporarily on a substrate by the second adhesive stripe, or mounted permanently on a record keeping sheet by the first adhesive stripe.

Preferably, the note pad includes release paper strips over the first adhesive stripes, and the first adhesive is pressure sensitive. Alternatively, the first adhesive may be moisture activatable.

Desirably, the first stripe extends across the width of the sheet spaced towards the upper edge thereof. In the preferred embodiments, the second stripe is spaced adjacent the upper edge of the sheets and the first stripe is disposed therebelow.

The binder means includes an adhesive coating along an edge of the sheets, and desirably includes a cover with top and bottom panels disposed above and below the stacked sheets, and a spine extending therebetween along the upper edge of the stacked sheets with the adhesive coating thereon. The stripes occupy only a portion of the total surface area of the sheets, and the adhesive free portion may be lifted to expose an underlying portion of recording sheet upon which mounted.

In a record keeping method using the note pad, information is written or otherwise recorded on the top surface of the uppermost of the stacked sheets, and it is removed from the pad. The removed sheet is adhered to the surface of a record keeping sheet by the first adhesive stripe which secures it against inadvertent removal.

However, the note may also be temporarily secured to a substrate by the second adhesive stripe and thereafter detached from the substrate prior to adhering it to the record keeping sheet.

DETAILED DESCRIPTION OF THE PREFERRED EMBODIMENT

Figure 1:
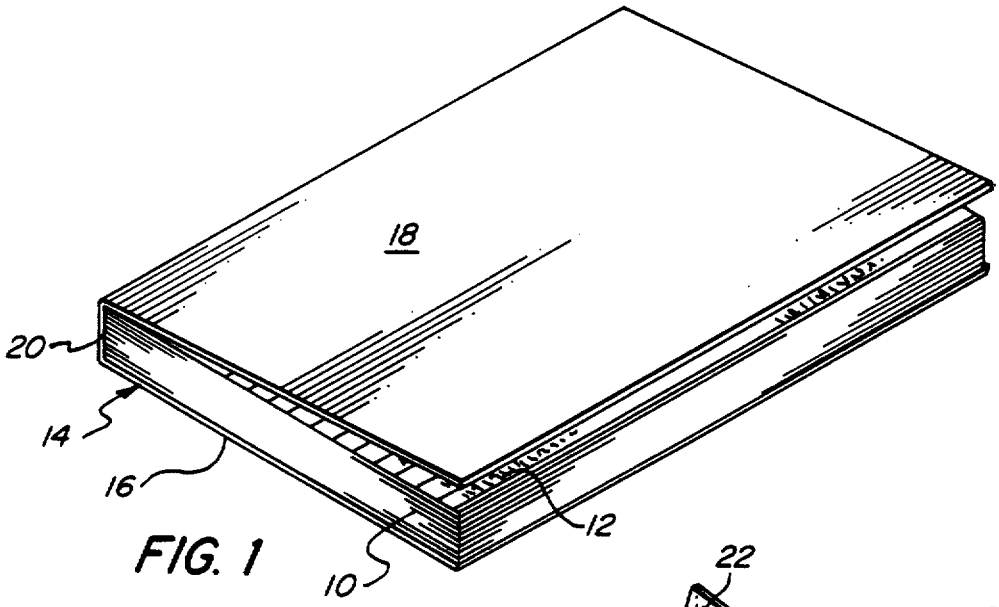
FIG. 1 is a perspective view of a note pad embodying the present invention with the top panel of the binder partially elevated.
Figure 2:
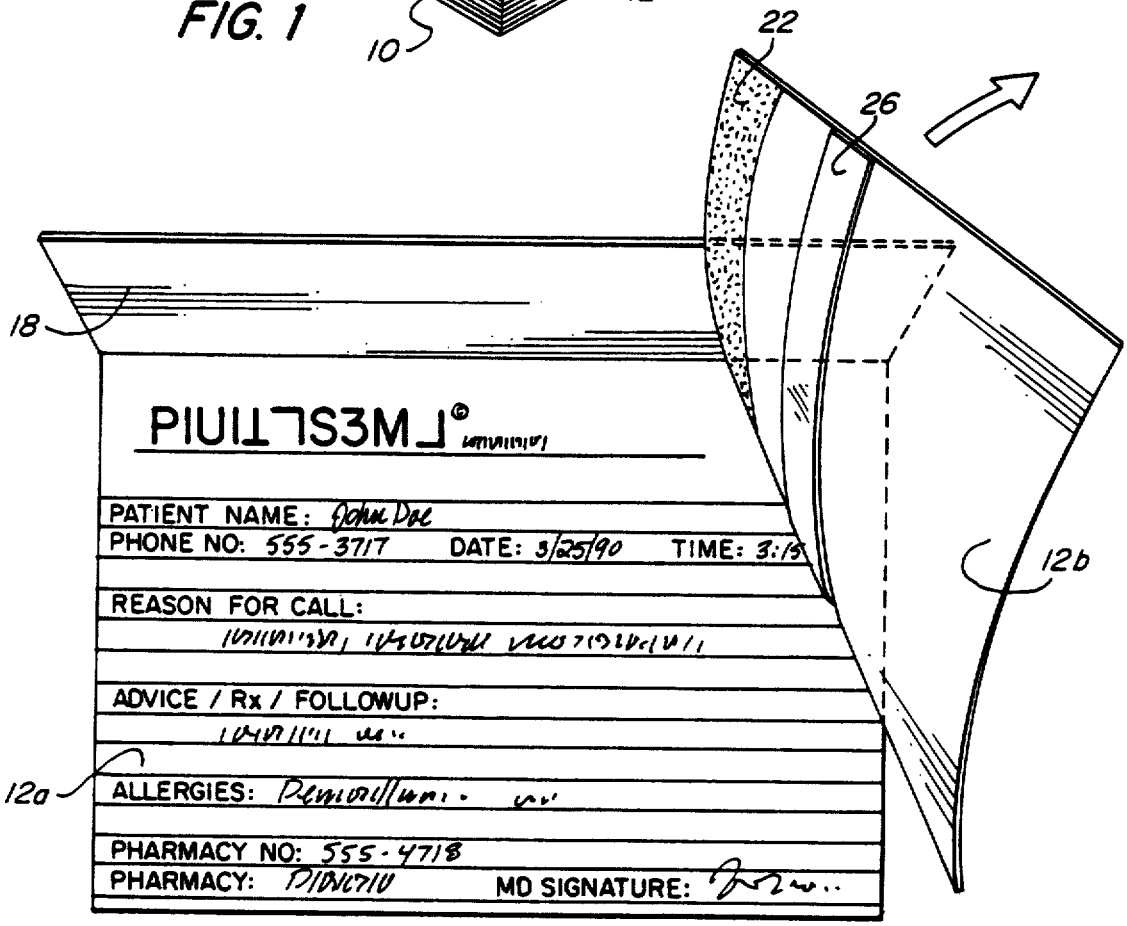
FIG. 2 is a plan view of the pad with the cover panel in an open position and with the uppermost sheet being removed to show the next sheet with information recorded thereon.

Turning first to FIGS. 1 and 2 of the attached drawings, therein illustrated is a note pad embodying the present invention and generally comprised of a stack 10 of a multiplicity of flexible recording note sheets such as paper or the like generally designated by the numeral 12. The stack 10 is disposed within a binder generally designated by the numeral 14. As see in FIG. 1, the binder has a bottom panel 16, a top panel 18 and a spine 20 which has on its inside surface a coating of adhesive (not shown) adhesively securing to the inside surface thereof the upper edges of the sheets 12.

In FIG. 2, the top panel 18 has been elevated into a position in which a user may write upon the top surface of the uppermost note sheet **12*a*, and the sheet 12*a*** is shown as a form of the type which a physician might use for recording patient advice during a telephone call including the recording of a prescription which might be called into a pharmacy. As also seen in FIG. 2, the uppermost sheet 12*b* is being peeled from the top of the pad to expose the sheet 12*a* which is therebelow.

Figure 3:
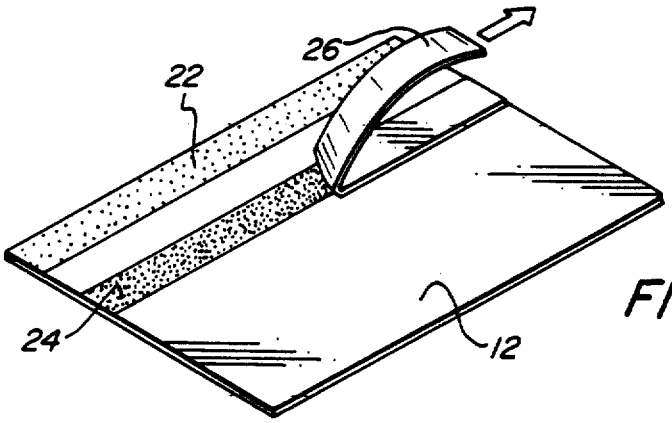
FIG. 3 is a perspective view of the rear surface of a sheet from the note pad showing the release paper strip being removed from the coating of permanent pressure sensitive adhesive.
Figure 5:
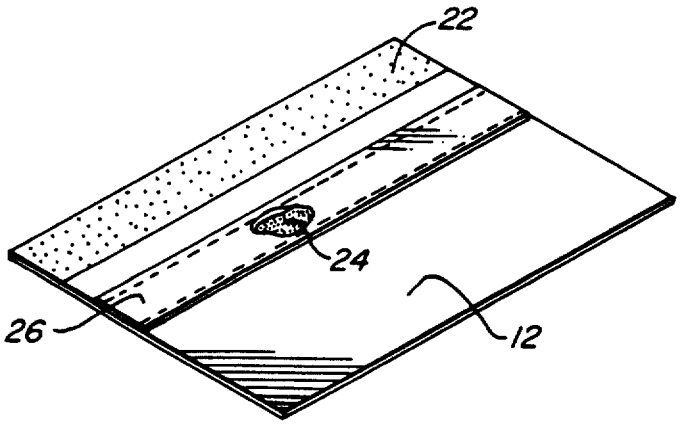
FIG. 5 is a view similar to FIG. 3 showing the release paper strip fully covering the permanent adhesive stripe.

Turning now to FIGS. 3 and 5, the note pads of the present invention utilize note sheets 12 which have two adhesive stripes upon the lower surface thereof. The upper stripe 22 as seen in FIGS. 3 and 5 is of a tacky repositionable pressure sensitive adhesive and this stripe is desirably disposed along the width dimension of the note pad adjacent the uppermost edge thereof.

Figure 4:
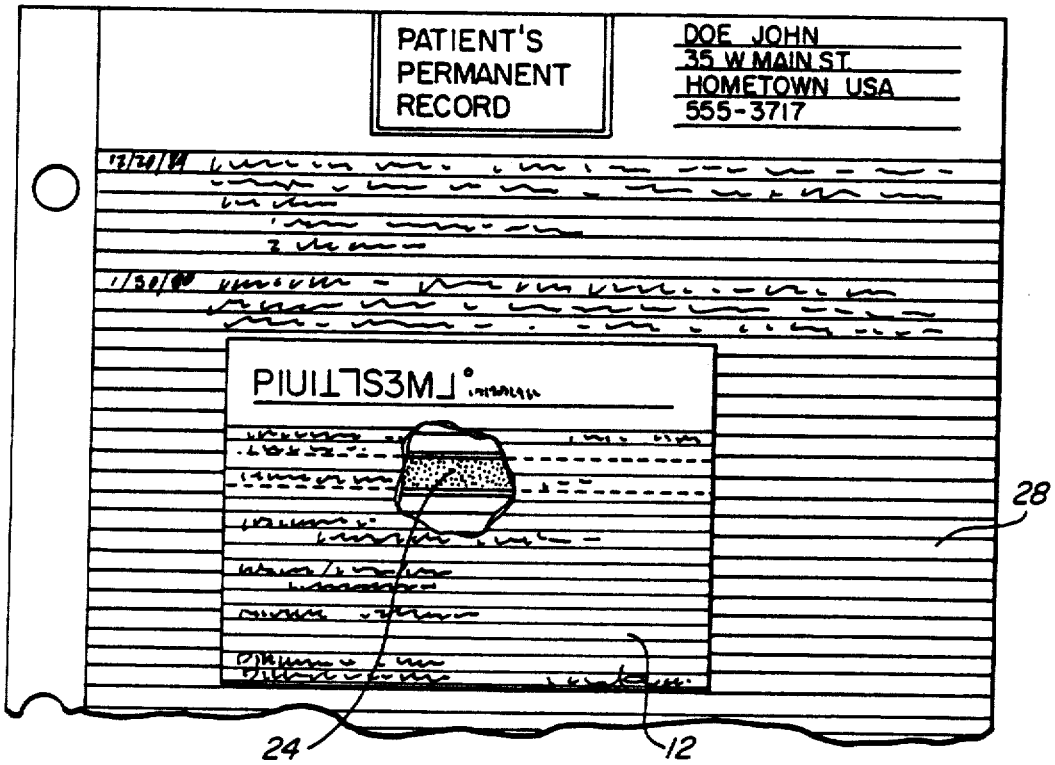
FIG. 4 is a fragmentary plan view of a patient's record showing the note sheet permanently mounted thereon, and with a portion of the note sheet broken away to show on the reverse side thereof the adhesive layer by which it is mounted onto the permanent record sheet.

Spaced therebelow is a second stripe 24 of pressure sensitive adhesive of a permanent nature, and there is disposed thereover a peelable strip 26 of release paper which covers the adhesive stripe 24 until such time as it is desired to permanently affix the note sheet 12 to a record keeping sheet. At that time, the release paper strip 26 can be easily peeled from the note sheet 12 as seen in FIG. 3 to expose the adhesive stripe 24 and enable permanent engagement of the note 12 onto a permanent record sheet 28 as seen in FIG. 4.

In use of the note pads of the present invention, the information can be recorded on the top sheet or on any number of sheets 12 in the stack by folding upwardly the previously used sheets until it is desired to remove the individual sheets for placement in a record keeping system. At such time, the sheets are removed from the stack 10 and, if only temporary adhesion is desired, the note sheet 12 is placed upon a suitable support surface and pressure is applied along the top of the note sheet 12 in the area of the first stripe 22 to adhere it to a substrate such as the permanent record sheet 28. When it is desired to effect permanent adhesion of the note sheet 12 to a permanent record sheet 28, the release paper strip 26 is removed and the note sheet 12 is placed in position on the permanent record sheet 28. Pressure is then applied along the area of the second adhesive stripe 24 to firmly bond the note sheet 12 to the surface of the permanent record sheet 28.

In the preferred embodiments of the present invention, the first adhesive stripe or stripe of repositionable tacky pressure sensitive adhesive is located adjacent the upper edge of the note sheet and the second stripe of the permanent adhesive is spaced therebelow. Moreover, the stripes desirably extend transversely of the width of the note sheet and are disposed so that they occupy only a portion of the total surface of the sheet. This limits the amount of the surface area of the substrate which is permanently obscured thereby while still providing sufficient bonding area. Thus, the adhesive free portion of the note sheet may be lifted to view a portion of the record sheet which is disposed thereunder.

It will be appreciated that, for some applications, it may be desirable to have the adhesive stripes extending along one side edge of the note sheets so as to enable their engagement upon the permanent record sheet along a side edge thereof. This will enable viewing of even more of the underlying record sheet.

As an alternative to the pressure sensitive permanent adhesive used for the second stripe and its release paper strip, a moisture activatable adhesive may be employed and this may be licked or otherwise moistened to effect its engagement to the permanent record sheet.

Paper will normally be used for the note sheets so as to provide an economical pad and enable easy recording of information thereon by pen, pencil or the like. However, laminates, surface treated plastic film, foils, and other materials which will permanently receive writings by pen or other devices may be employed if so desired. Although surface treatment of the bottom surface of the note sheets is not necessary for use in the present invention, such treatment can be employed to increase the bond strength of the adhesive to the surface of the note sheet if so desired.

In the illustrated embodiment, the binder comprises top and bottom panels and a spine. If so desired, the binder may include only a base panel and an adhesive coating along the upper edge of the note sheets to effect their engagement together. Moreover, if so desired, the sheets may be perforated along a line adjacent the edge at which they are bound, and the note sheets can be severed along the perforated line to effect their removal from the stack.

The uses for the note pads of the present invention are readily apparent. As in the illustrated embodiment, physicians may use these pads for recording all types of patient information, prescriptions, etc., and the sheets are readily placed upon the permanent record chart of the patient. Lawyers and accountants can make use of such note pads which may be carried in a pocket and they may record information at various places away from the office and the information can then be transferred to the permanent records of the client. The note sheets of the pads may be preprinted with legends such as those shown in the illustrated embodiment: name, date, etc.

Thus, it can be seen from the foregoing detailed description and the attached drawings that the note pads of the present invention enable both temporary and permanent adhesion of the note sheets to a permanent record sheet or the like, and they may be simply and relatively economically fabricated. By proper selection of the adhesives, the bond to the permanent record sheets can be sufficiently strong to last for years, and the controlled application of the adhesive stripe enables minimization of the area of the record sheet which is obscured thereby and minimizes the likelihood that the adhesive stripe will have a deleterious effect upon other information placed upon the permanent record sheet.

Having thus described the invention, what is claimed is:

1. A note pad for use with hard copy record keeping systems comprising:

(a) a multiplicity of stacked flexible sheets each having a top surface for receiving writings and a bottom surface, and further having width and length dimensions;

(b) a first stripe of a first adhesive on the bottom surface of each of said sheets extending substantially across one dimension of said sheets, said first adhesive being adapted to adhere firmly to a record keeping sheet;

(c) a second stripe of a second adhesive on the bottom surface of each of said sheets extending substantially across said one dimension of said sheets, said second adhesive being a tacky repositionable pressure sensitive adhesive to releasably bond to a record keeping sheet; and (d) binder means securing said sheets in stacked assembly and permitting removal of individual sheets therefrom, whereby said flexible sheets may be mounted temporarily by said second stripe and mounted permanently on a record keeping sheet by said first stripe.

2. The note pad in accordance with claim 1 wherein said note pad includes a release paper strip over said first adhesive stripe of each said sheets, said first adhesive being pressure sensitive.

3. The note pad in accordance with claim 1 wherein said first adhesive is moisture activatable.

4. The note pad in accordance with claim 1 wherein said first adhesive stripe extends across the width of said sheet spaced towards an upper edge thereof.

5. The note pad in accordance with claim 4 wherein said second adhesive stripe is spaced adjacent the upper edge of each of said sheets and said first adhesive stripe is disposed therebelow.

6. The note pad in accordance with claim 5 wherein said note pad includes release paper strips over said first adhesive stripes, and said first adhesive is pressure sensitive.

7. The note pad in accordance with claim 1 wherein there is included a cover with a top and bottom panels disposed above and below said stacked sheets and a spine extending therebetween along the upper edge of said stacked sheets.

8. The note pad in accordance with claim 1 wherein said adhesive stripes occupy only a portion of the total surface area of said sheets, and an adhesive free portion may be lifted to expose an underlying portion of the recording sheet upon which mounted.

9. In the method of keeping records, the steps comprising:

(a) providing a note pad having (i) a multiplicity of stacked flexible sheets each having a top surface for receiving writings and a bottom surface, and further having width and length dimensions, (ii) a first stripe of a first adhesive on the bottom surface of each of said sheets extending substantially across one dimension of said sheets, said first adhesive being adapted to adhere firmly to a record keeping sheet, (iii) a second stripe of a second adhesive on the bottom surface of each of said sheets extending substantially across said one dimension of said sheets, said second adhesive being a tacky repositionable pressure sensitive adhesive to releasably bond to a record keeping sheet; and (iv) binder means securing said sheets in stacked assembly and permitting facile removal of individual sheets therefrom;

(b) recording information on the top surface of the uppermost of said stacked sheets;

(c) removing said uppermost sheet from said pad; and (d) adhering said removed sheet on the surface of a record keeping sheet by said first adhesive stripe, said first adhesive securing said sheet to said record keeping sheet against inadvertent removal.

10. The record keeping method in accordance with claim 9 wherein said note pad includes release paper strips over said first adhesive stripes, and said first adhesive is pressure sensitive, and wherein there is included the step of removing said release paper strip from said removed sheet prior to securing it to said record keeping sheet.

11. The record keeping method in accordance with claim 10 including the step of temporarily securing said removed sheet to a substrate by said second adhesive stripe and thereafter detaching said removed sheet from said substrate prior to adhering it to said record keeping sheet.

12. The record keeping method in accordance with claim 9 wherein said first adhesive is moisture activatable, and wherein there is included the step of moistening said first adhesive stripe prior to securing to said record.

* * * * *